US006074711A

United States Patent [19]

Ghazarian

[11] Patent Number: 6,074,711

[45] Date of Patent: Jun. 13, 2000

[54] KIT FOR CONSTRUCTING A VARIETY OF RELIGIOUS CROSSES

[76] Inventor: Anni M. Ghazarian, 20 Forest Manor Rd., Unit 1410 North York Ontario, Canada, M2J IM2

[21] Appl. No.: 09/016,955

[22] Filed: Feb. 2, 1998

[51] Int. Cl.[7] ..... A44C 23/00

[52] U.S. Cl. ..... 428/3; 428/14; 428/42.1; 428/906.6

[58] Field of Search ..... 428/3, 14, 42.1, 428/906.6

[56] References Cited

U.S. PATENT DOCUMENTS

| | | | |
|---|---|---|---|
| D. 257,069 | 9/1980 | Wozniski | D99/27 |
| D. 299,779 | 2/1989 | Kohen et al. | D99/27 |
| 3,024,901 | 3/1962 | Ceralo | 428/3 X |
| 4,149,305 | 4/1979 | Blumhof | 428/906.6 X |
| 4,275,028 | 6/1981 | Cohen | 428/255 X |
| 4,634,616 | 1/1987 | Musante et al. | 428/42.1 |
| 5,103,758 | 4/1992 | Clark | 116/237 |
| 5,141,438 | 8/1992 | Spector | 434/87 |
| 5,191,200 | 3/1993 | Howell | 428/14 X |
| 5,325,811 | 7/1994 | Miroyan | 116/235 |
| 5,683,769 | 11/1997 | Cheng | 428/14 X |

*Primary Examiner*—Deborah Jones
*Assistant Examiner*—Cathy Lam

[57] ABSTRACT

The present invention relates to a kit which can be employed to construct a variety of different religious crosses. The kit includes a sheet of lattice material, a length of ribbon, a ribbon rose, a needle, a number of different sized split rings, a bar pin, a number of beads, a magnet and a package of glue. Through the use of the kit, a user can construct either a cross bookmark, pin, keychain, or magnet.

1 Claim, 3 Drawing Sheets

FIG. 4
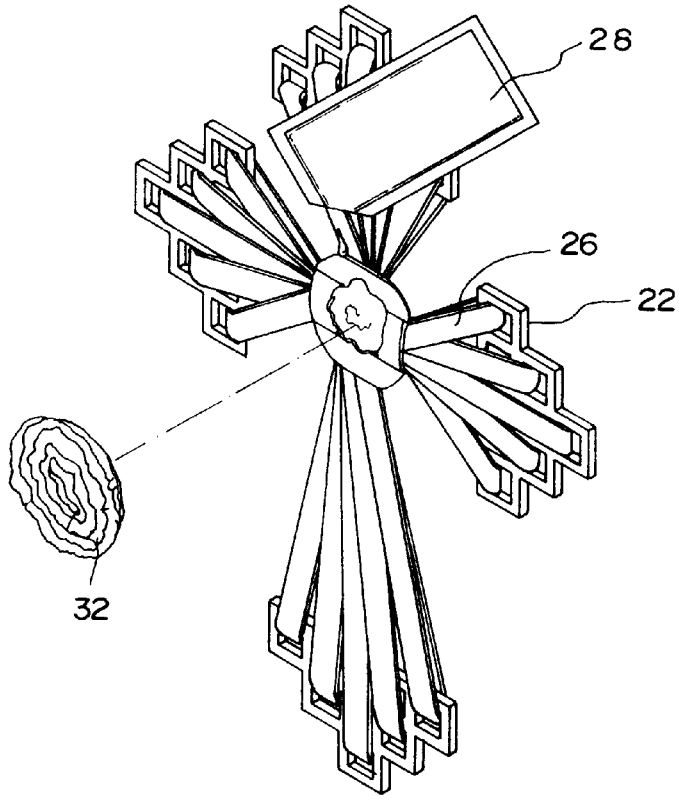
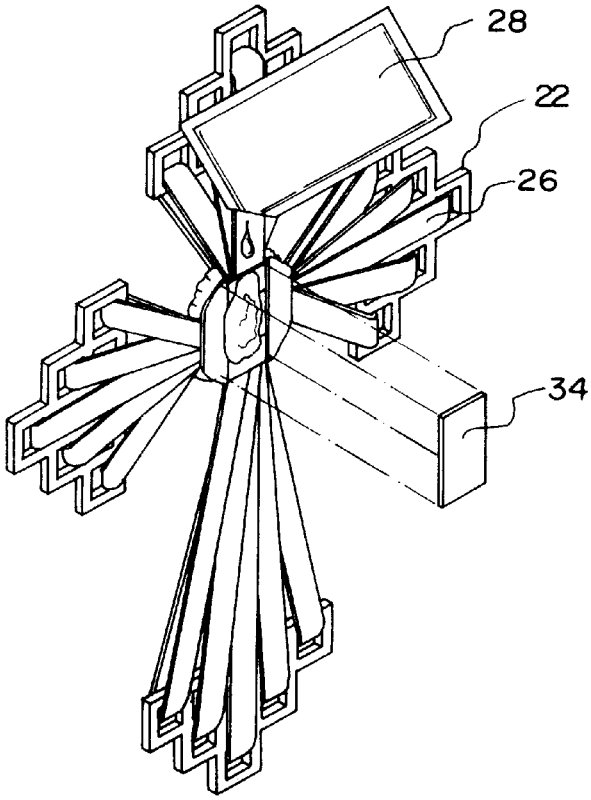
FIG. 5

KIT FOR CONSTRUCTING A VARIETY OF RELIGIOUS CROSSES

BACKGROUND OF THE INVENTION

1. Field of the Invention

The present invention relates to a kit and more particularly pertains to a kit which can be employed in constructing a variety of different types of religious crosses.

2. Description of the Prior Art

The use of craft kits are known in the prior art. More specifically, craft kits are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,141,438 to Spector discloses a art craft kit. U.S. Pat. No. 5,325,811 to Miroyan discloses a bookmark. U.S. Patent No. Des. 299,779 to Kohen discloses a crucifix design. U.S. Pat. No. 5,103,758 to Clark discloses a bookmark construction. U.S. Pat. No. 4,634,616 to Musante discloses a stencil art overlay. Lastly, U.S. Pat. No. Des. 257,069 to Wozniski discloses a crucifix design.

In this respect, the kit of the present invention substantially departs from the conventional concepts and designs of the prior art, and in so doing provides an apparatus primarily developed for the purpose of giving the user a choice of what to construct.

Therefore, it can be appreciated that there exists a continuing need for improved craft kits. In this regard, the present invention substantially fulfills this need.

SUMMARY OF THE INVENTION

In view of the foregoing disadvantages inherent in the known types of craft kits now present in the prior art, the present invention provides a kit which can be employed in a number of different ways. As such, the general purpose of the present invention, which will be described subsequently in greater detail, is to enable a user to construct a number of different articles from a single kit.

To attain this, the present invention essentially comprises a kit which can be employed to construct a variety of different religious crosses. The kit includes a sheet of lattice material, a length of ribbon, a ribbon rose, a needle, a number of different sized split rings, a bar pin, a number of beads, a magnet and a package of glue. Through the use of the kit, a user can construct either a cross bookmark, pin, keychain, or magnet.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved kit for use in constructing a variety of religious crosses each functioning in a different manner. The kit provides a sheet of lattice material, wherein the lattice material is perforated such that a lattice cross may be separated from the surrounding lattice material. The lattice cross has a lengthwise dimension, a crosswise dimension, and an intersection. The kit also provides a needle for use in threading material though the various lattice cells, a length of ribbon, the ribbon adapted secured to the needle and threaded through the various lattice cells. The ribbon is adapted to be repeatedly threaded through cells along the lengthwise dimension of the cross, the ribbon then being repeatedly threaded through cells along the crosswise dimension of the cross, in this manner the ribbon is formed into a cross upon the lattice material. The kit also provides an amount of tacky glue for use upon the ribbon material. The kit also provides a ribbon rose which is adapted to be secured to the intersection of the cross through the use of the tacky glue. The kit also provides a magnet, the magnet adapted to be secured to the ribbon material through the use of the tacky glue such that the cross can be secured to a metallic surface. The kit also provides a number of different sized split rings, the ribbon is adapted to be threaded through one of the split rings such that the cross can be used as a keychain. The kit also provides a bar pin having a base portion. The bar pin is adapted to be secured to the cross by threading the ribbon material over the base material such that the cross can be used as a pin. The kit also provides a series of tri beads, wherein the beads are adapted to be secured to the ribbon material such that the cross can be employed as a bookmark.

It is another object of the present invention to provide a kit which creates an eyepleasing piece of art.

It is a further object of the present invention to provide a kit which provides all the elements necessary to construct a variety of different works of art.

An even further object of the present invention is to provide a kit which is susceptible of a low cost of manufacture with regard to both materials and labor, and which accordingly is then susceptible of low prices of sale to the consuming public, thereby making such kits economically available to the buying public.

Still yet another object of the present invention is to provide a kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a view of the ribbon rose being secured to the cross.

FIG. 5 is a view of the magnet being secured to the cross.

Similar reference characters refer to similar parts throughout the several views of the drawings.

DESCRIPTION OF THE PREFERRED EMBODIMENT

The present invention relates to a kit which can be employed to construct a variety of different religious crosses. The kit includes a sheet of lattice material, a length of ribbon, a ribbon rose, a needle, a number of different sized split rings, a bar pin, a number of beads, a magnet and a package of glue. Through the use of the kit, a user can construct either a cross bookmark, pin, keychain, or magnet. The various components of the present invention, and the manner in which they interrelate, will be described in greater detail hereinafter.

The kit 10 of the present invention is for use in constructing a variety of religious crosses. Each of the resulting crosses functions in a different manner.

Figure 1:
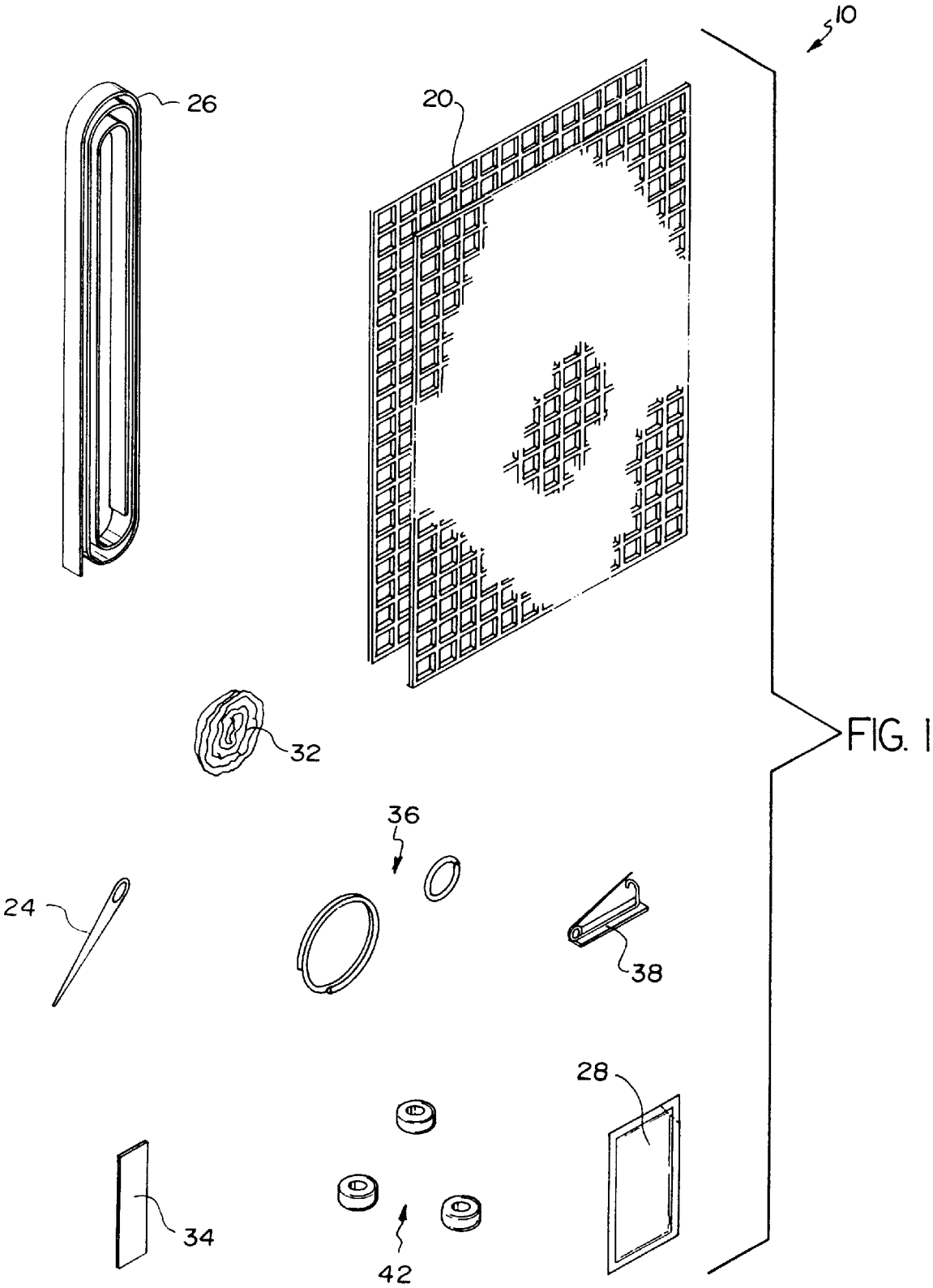
FIG. 1 is a view of all the components of the kit of the present invention.
Figure 2:
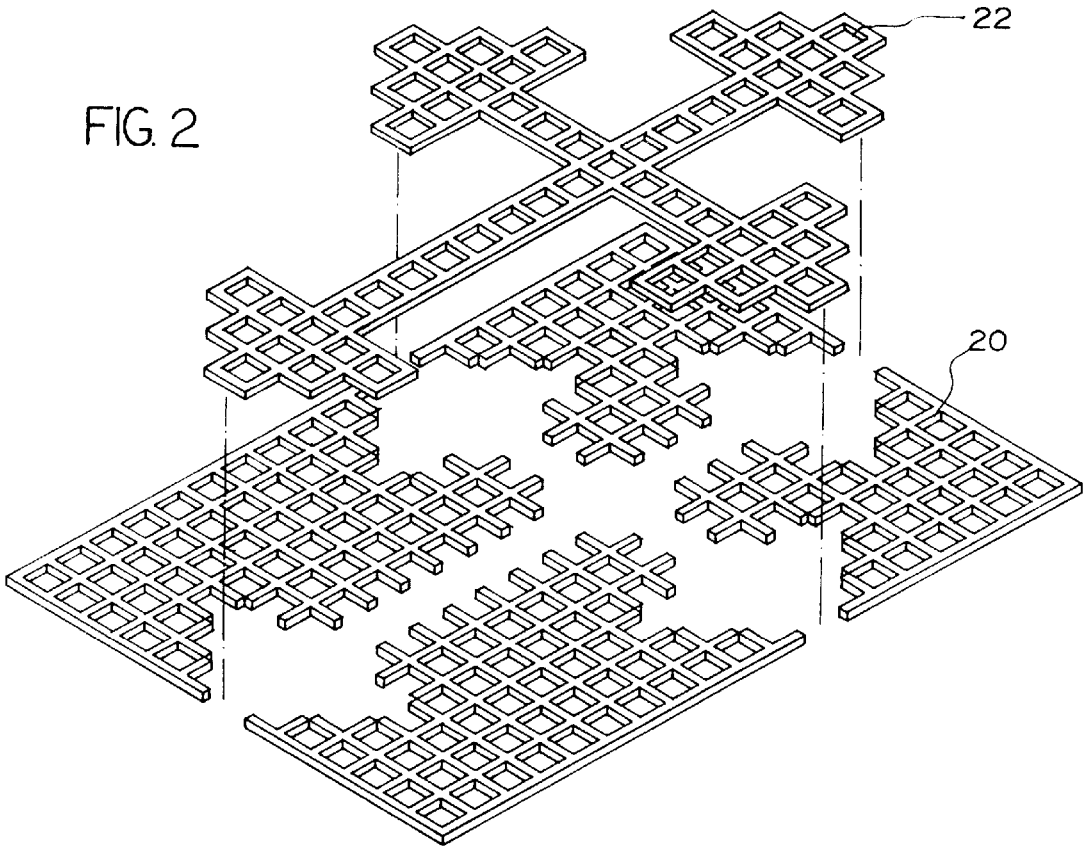
FIG. 2 is a view of the lattice material.

A sheet of lattice material 20 is provided in the kit 10. This lattice material 20, in the preferred embodiment, is perforated such that a lattice cross 22 may be separated from the surrounding lattice material 20, note FIG. 2. In the preferred embodiment, the lattice 20 is constructed from a plastic material. The lattice cross 22, once separated, is defined by a lengthwise dimension, a crosswise dimension, and an intersection.

Figure 3:
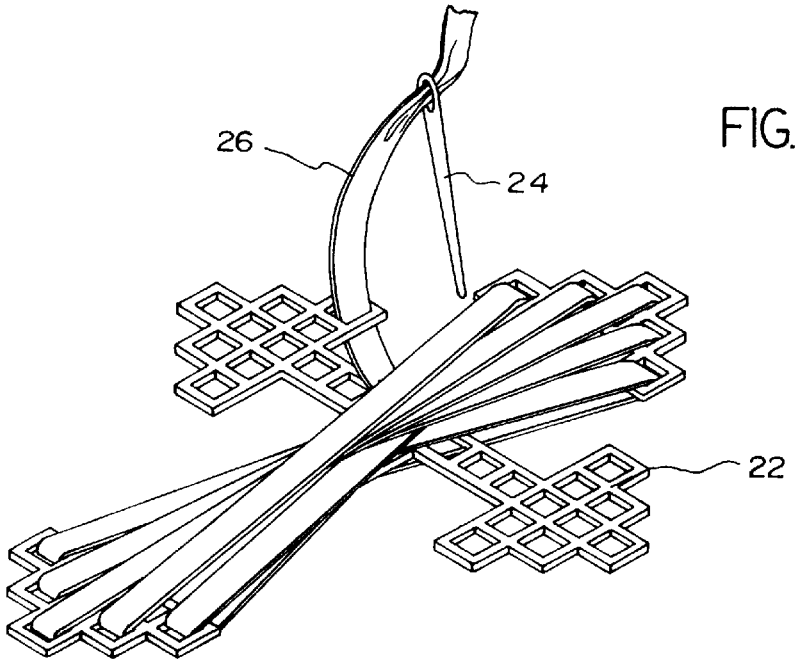
FIG. 3 is a view of the ribbon being threaded upon the lattice material.

A needle 24 is also provided in the kit 10 for use in threading material though the various lattice cells in a manner which will be described more full herein. The kit also provides a length of ribbon 26. In the preferred embodiment, the ribbon 26 is of a satin material. The ribbon 26 is thus adapted to be secured to the needle 24 and threaded through the various lattice cells, note FIG. 3. The ribbon 26 is thus repeatedly threaded through cells along the lengthwise dimension of the cross. Next, the ribbon 26 is repeatedly threaded through cells along the crosswise dimension of the cross. In such a manner, the ribbon 26 is formed into a cross upon the lattice material 20, note FIGS. 4 and 5. The kit 10 also provides its user with an amount of tacky glue 28 for use upon the ribbon material 26. For example, the glue 28 is employed is securing a ribbon rose 32 to the intersection of the cross. The ribbon rose 32, which is provided in the kit 10, is preferably constructed from a satin material.

One of the key features of the present invention is the ability for the user to construct a variety of different types of crosses: a bookmark cross, a keychain cross, a pin cross, or a magnet cross. How the kit enables a user to construct these items will next be described.

A magnet 34 is provided in the kit 10 for use in constructing a cross magnet. Specifically, the magnet 34 is adapted to be secured to the ribbon material 26 through the use of the tacky glue 28 such that the cross can be secured to a metallic surface. A number of different sized split rings 36 are also provided in the kit 10 for use in constructing keychain crosses. More specifically, when constructing the cross the ribbon 26 is adapted to be threaded through one of the split rings 36. Or, the split ring can be secured to the lattice structure itself. Thus, upon completion of the cross it can be used as a keychain. A bar pin 38 is also provided in the kit 10. By providing the bar pin 38 the user has the option of creating a cross pin. The pin 38 is defined by a base portion and a pivotal pin portion. The pin 38 is adapted to be secured to the cross by threading the ribbon material 26 over the base portion of the pin 38. In the preferred embodiment, the base is secured approximate to the intersection of the cross. Lastly, a number of beads 42 are provided in the kit 10. In the preferred embodiment these are "tri" beads 42. The beads 42 are adapted to be secured to a length of the ribbon material 26, which the ribbon material secured to the remainder of the cross. In this manner the cross can be employed as a bookmark.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A kit for use in constructing a variety of religious crosses each functioning in a different manner, the kit comprising in combination:

providing a sheet of lattice material, the lattice material being perforated such that a lattice cross may be separated from the surrounding lattice material, the lattice cross having a lengthwise dimension, a crosswise dimension, and an intersection;

providing a needle for use in threading material though the various lattice cells;

providing a length of ribbon, the ribbon adapted secured to the needle and threaded through the various lattice cells, the ribbon being repeatedly threaded through cells along the lengthwise dimension of the cross to form plural crossing components, the ribbon then being repeatedly threaded through cells along the crosswise dimension of the cross to form plural crossing components, in this manner the ribbon is formed into a cross upon the lattice material with the lengthwise dimension being greater than the crosswise dimension;

providing an amount of tacky glue for use upon the ribbon material;

providing a ribbon rose which is adapted to be secured to the intersection of the cross through the use of the tacky glue;

providing a magnet, the magnet adapted to be secured to the ribbon material through the use of the tacky glue such that the cross can be secured to a metallic surface;

providing a number of different sized split rings, the ribbon adapted to be threaded through one of the split rings such that the cross can be used as a keychain;

providing a bar pin having a base portion, the bar pin adapted to be secured to the cross by threading the ribbon material over the base material such that the cross can be used as a pin;

providing a series of tri beads, the beads adapted to be secured to the ribbon material such that the cross can be employed as a bookmark.

* * * * *